US006668520B1

(12) United States Patent
Wood

(10) Patent No.: US 6,668,520 B1
(45) Date of Patent: Dec. 30, 2003

(54) MODULAR SLIDING DOOR GRID

(75) Inventor: Katrin C. Wood, East Hampton, CT (US)

(73) Assignee: Standard Knapp Inc., Portland, CT (US)

( * ) Notice: Subject to any disclaimer, the term of this patent is extended or adjusted under 35 U.S.C. 154(b) by 253 days.

(21) Appl. No.: 09/596,733

(22) Filed: Jun. 16, 2000

(51) Int. Cl.[7] ..... B65G 1/06
(52) U.S. Cl. ..... 53/260; 53/247
(58) Field of Search ..... D25/119; 49/404, 49/453, 456; 53/247, 201, 237, 260

(56) References Cited

U.S. PATENT DOCUMENTS

| | | | | | |
|---|---|---|---|---|---|
| 3,673,756 | A | * | 7/1972 | Prete et al. | 53/247 |
| 4,109,981 | A | * | 8/1978 | Pfaehler | 312/107 |
| 4,207,721 | A | | 6/1980 | Raudat et al. | 53/248 |
| 4,258,632 | A | * | 3/1981 | LaPointe | 109/59 R |
| 4,406,111 | A | | 9/1983 | Raubat | 53/497 |
| 4,446,672 | A | | 5/1984 | Raudat | 53/448 |
| 4,517,767 | A | * | 5/1985 | Dewson | 49/464 |
| 4,583,351 | A | | 4/1986 | Fallas | 53/501 |
| 4,644,734 | A | | 2/1987 | Hartness | 53/500 |
| 4,709,536 | A | | 12/1987 | Hartness et al. | 53/539 |
| 4,723,649 | A | | 2/1988 | Hartness et al. | 198/442 |
| 4,726,167 | A | | 2/1988 | Hartness | 53/248 |
| 4,830,173 | A | | 5/1989 | Hartness et al. | 198/442 |
| 4,833,860 | A | | 5/1989 | Hartness | 53/261 |
| 4,835,946 | A | | 6/1989 | Hartness et al. | 53/539 |
| 5,056,294 | A | * | 10/1991 | Focke | 53/201 |
| 5,127,191 | A | * | 7/1992 | Ohta | 49/62 |
| 5,197,261 | A | | 3/1993 | Hartness et al. | 53/534 |
| 5,347,790 | A | * | 9/1994 | Romanenko et al. | 414/790.3 |
| 5,392,587 | A | | 2/1995 | Crouch | 53/248 |
| 5,411,129 | A | | 5/1995 | Crouch | 198/442 |
| 5,487,257 | A | | 1/1996 | Domeier et al. | 53/539 |
| 5,588,282 | A | | 12/1996 | Hartness | 53/473 |
| 5,603,398 | A | | 2/1997 | Crouch | 198/459.2 |
| 5,778,634 | A | | 7/1998 | Weaver et al. | 53/250 |
| RE36,241 | E | * | 6/1999 | Phelps et al. | 414/746.8 |
| 5,927,053 | A | * | 7/1999 | Donovan et al. | 53/168 |
| 6,041,551 | A | * | 3/2000 | Aspenwall | 49/425 |
| 6,058,665 | A | * | 5/2000 | Halvorson et al. | 52/205 |
| 6,125,613 | A | * | 10/2000 | Eberhardt et al. | 53/432 |
| 6,330,769 | B1 | * | 12/2001 | Manzella et al. | 52/204.62 |

* cited by examiner

*Primary Examiner*—Stephen F. Gerrity
*Assistant Examiner*—John Paradiso
(74) *Attorney, Agent, or Firm*—Cantor Colburn LLP

(57) ABSTRACT

A modular sliding door grid including a sliding door mounted on a low profile frame. The sliding door is actuated by at least one pivot bar, connected at one end to the sliding door and at the other end to a mechanical linkage. Actuation of a frame bar in a forward direction urges the mechanical linkage in a forward direction and causes the pivot bar to move around a center-point such that the sliding door moves in a backward direction. The backward movement of the sliding door removes support for a case load positioned on the sliding door so that the case load drops.

9 Claims, 6 Drawing Sheets

SECTION A-A

SECTION B-B

SECTION C-C

MODULAR SLIDING DOOR GRID

TECHNICAL FIELD

The present invention relates generally to case packing. More particularly, the present invention relates to a modular sliding door grid for use in ultra high-speed case packing.

BACKGROUND OF THE INVENTION

In response to the demands for diversity in today's case packing market (e.g., full depth RSC or Bliss cases), the case packing industry has been modifying case packer technology to provide customers with grids that handle a wider variety of multi-packed products. Not only are multi-packs in greater demand, but the variety of pack styles has also proliferated in recent years. Quick changeover and higher speeds are required to meet this recent surge in demand.

The speed and changeover limitations of the older technology are directly related to the complexity and shortfalls of "trap door" grids, such as are described in U.S. Pat. No. 4,583,351 to Fallas. The required movement of the trap door's vertical swing during case packing limits the maximum speed of case packing operations. For applications requiring speeds of 20 cases or less per minute, this is generally not a concern.

U.S. Pat. No. 4,644,734 to Hartness describes a low speed case packer employing two horizontally acting trap doors actuated by pneumatic cylinders. Bottles are indexed onto the trap door by fours until three rows are filled. Pneumatic cylinders are then actuated to slide the trap doors and drop the bottles. The Hartness device provides a low cost, reliable packing device, but it is not suitable for ultra-high speed case packing.

What is needed in the art is a low cost solution for ultrahigh speed case packing.

SUMMARY OF THE INVENTION

The above discussed and other drawbacks and deficiencies of the prior art are overcome or alleviated by the modular sliding door grid of the present invention. The modular sliding door grid includes a sliding door mounted on a low profile frame. The sliding door is actuated by at least one pivot bar, connected at one end to the sliding door and at the other end to a mechanical linkage. Actuation of a frame bar, which is linked to the mechanical linkage, in a forward direction causes pivot bar to move around a centerpoint to allow the sliding door to move in a backward direction.

The pivot bar configuration described shows a rugged design that allows for rapid actuation and retraction, such that the 40 or more cases may be packed in one minute. Further, the modularity of the sliding door grid allows a user to install or change out the sliding door grid in five minutes or less to accommodate varying packaging requirements based on the products to be packaged.

The above description and other features and advantages of the present invention will be appreciated and understood by those skilled in the art from the following detailed description, drawings and appended claims.

BRIEF DESCRIPTION OF THE DRAWINGS

Referring now to the drawings wherein like elements are numbered alike in the several FIGURES.

DESCRIPTION OF THE PREFERRED EMBODIMENT

Figure 1:
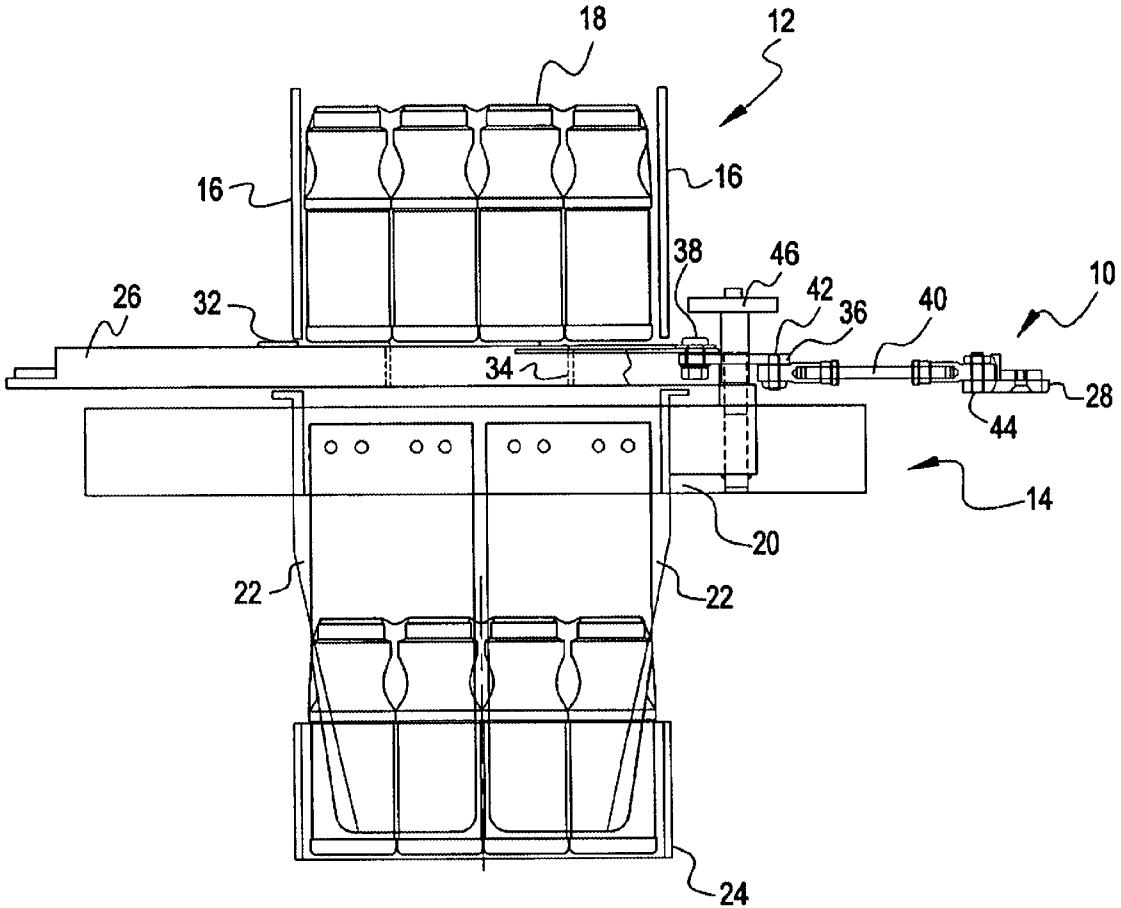
FIG. 1 is a cross sectional side view of an assembled case packing machine including the present modular sliding door grid.

Referring now to FIG. 1, a modular sliding door grid is generally shown assembled at 10 between an upper assembly, shown generally at 12, and a lower assembly, shown generally at 14. Upper assembly 12 includes lane guides 16 for positioning of a case load 18 over the sliding door grid 10. Lower assembly 14 includes a grid basket 20 further including grid fingers 22, which accept a case load 18 discharged through the sliding door grid 10 and which guide the discharged case load 18 properly into case 24.

Referring still to FIG. 1, modular sliding door grid 10 includes a mounting block 26, first and second frame bars 28, 30, a fixed door 32 mounted thereto, a sliding door 34, a pivot bar 36, attached to the sliding door 34 by a connecting pin 38, and a mechanical linkage 40, attached to the pivot bar 36 by connecting pin 42. The mechanical linkage 40 is connected at an opposite end to a first frame bar 28 by connecting pin 44. A mechanical pivot pin 46 is shown provided through the pivot bar 36, into the mounting block 26 of the sliding door grid 10 and into the grid basket of the lower assembly 14.

Figure 2:
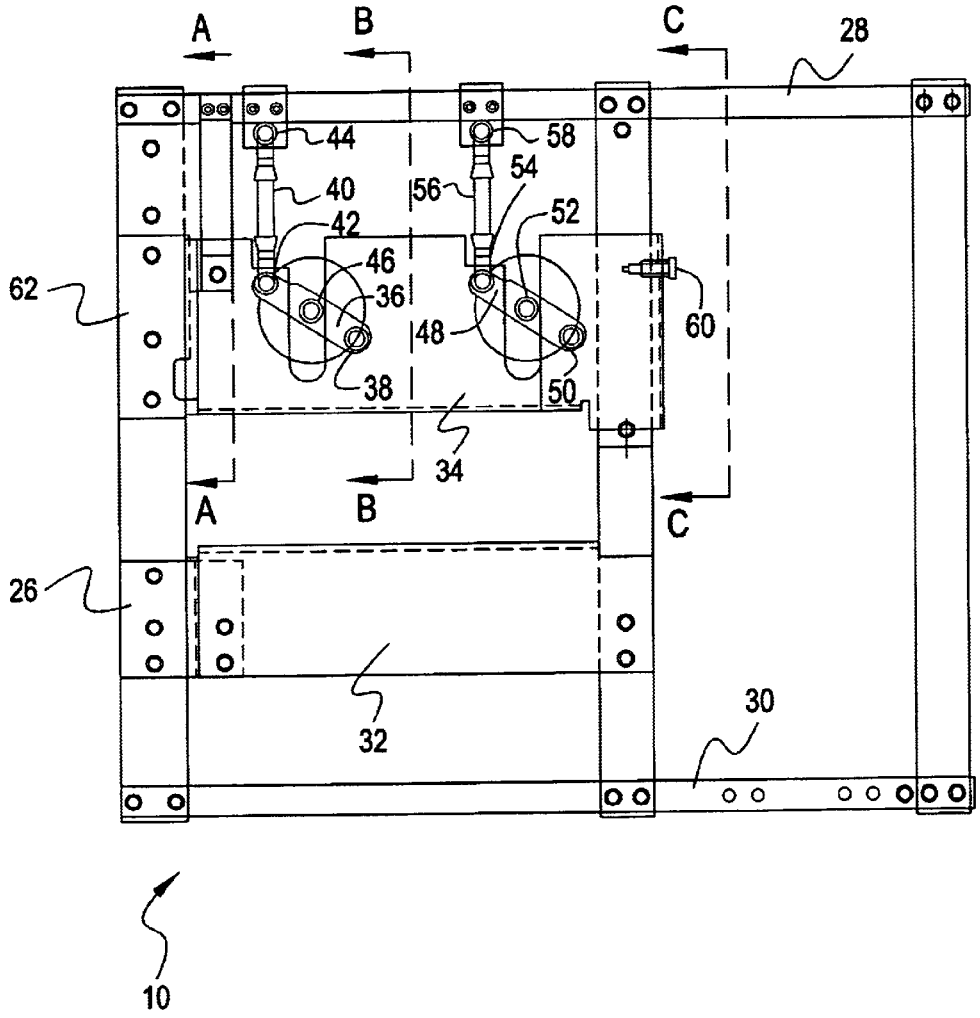
FIG. 2 is an overhead view of the modular sliding door grid.

Turning now to FIG. 2, an overhead view of the modular sliding door grid 10 shows a sliding door 34 attached to two pivot bars 36, 48 by connecting pins 38, 50. Pivot pins 46, 52 are shown provided centrally through the pivot bars 36, 48. Mechanical connecting pins 42, 54 link pivot bars 36, 48 to the mechanical linkages 40, 56. Connecting pins 44, 58 link mechanical linkages 40, 56 to first frame bar 28. The sliding door 34 is shown in an extended position relative to the fixed door 32. A shoulder stud 60 aids in the extension and retraction of the sliding door 34 by securing the sliding door 34 to the frame 26, thus ensuring the sliding door remains in a sliding position along the first door guide 62.

Figure 3:
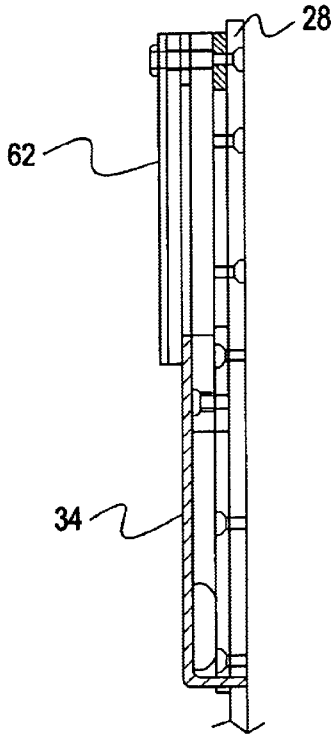
FIG. 3 is a cross sectional side view of the sliding door and top door guide assembly.
Figure 4:
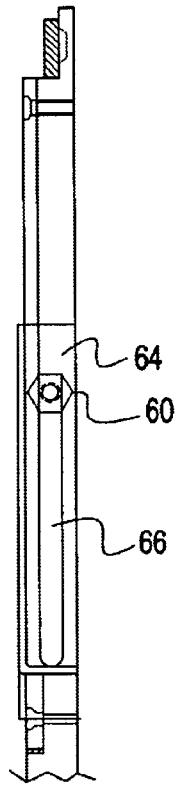
FIG. 4 is a cross sectional side view of the sliding door and pivot arm assembly.

Referring now to FIG. 3, section A—A of FIG. 2, the sliding door 34 is shown underneath and against the first door guide 62, which is mounted to the mounting block 26. Referring now to FIG. 4, section C—C of FIG. 2, a second door guide 64 is shown, providing a track at 66 to allow door stud 60, which is attached to the sliding door 34, to slide with the sliding door 34 during extension and retraction.

Figure 5:
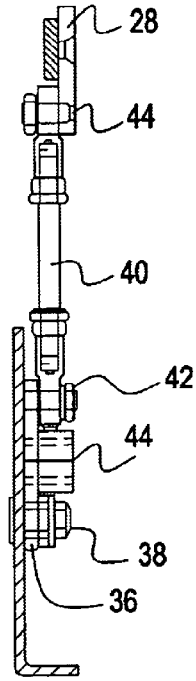
FIG. 5 is a cross sectional side view of the sliding door and side door guide assembly.

Referring now to FIG. 5, section B—B of FIG. 2, the sliding door 34 connects to the pivot bar 36 by the mechanical connecting pin 38. Across the pivot pin 46 on the pivot bar 36, the mechanical linkage 40 connects to the pivot bar 36 by the mechanical connecting pin 42. The mechanical linkage 40 connects to the first frame bar 28 by the mechanical connecting pin 44.

Figure 6:
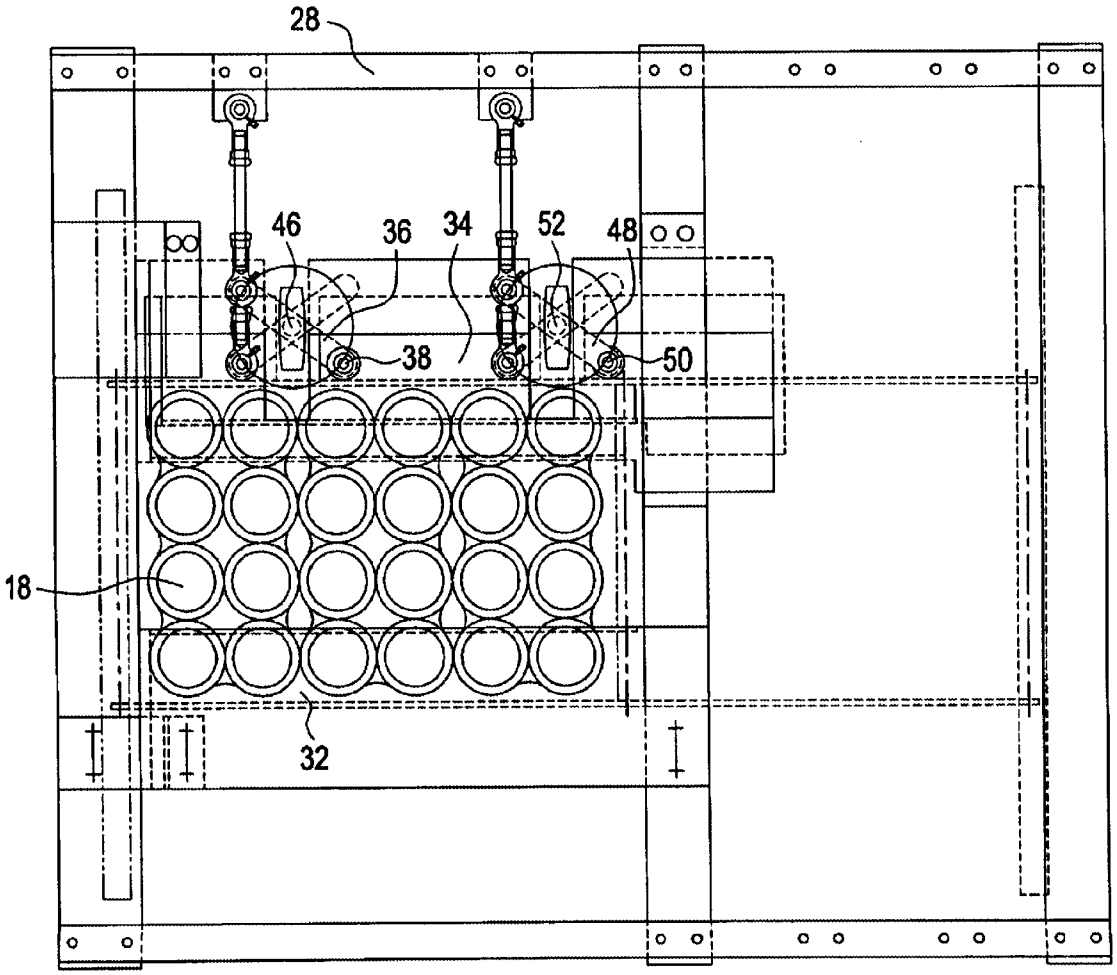
FIG. 6 is an overhead view showing discrete actuated positions of the sliding door and pivot arms.

Turning now to FIG. 6, the sliding door 34 is shown connected to pivot bars 36, 48, as in FIG. 2. Pivot bars 36, 48 are shown in two positions, such that the sliding door 34 is extended (A) and retracted (B). In operation, the first frame bar 28 is actuated horizontally towards the pivot pins 46, 52, causing the pivot bars 36, 48 to rotate around the pivot pin 46, 52. The connecting pins 38, 50, attached to the sliding door 34, move in a counterclockwise direction with the pivot bars 36, 48 to urge the sliding door 34 toward the first frame bar 28, thereby widening the gap between the sliding door 34 and the fixed door 32 and causing the case 18 to drop. Though movement of connecting pins 38, 50 are shown to be counterclockwise, the present invention contemplates alternate setups, where movement of connecting pins 38, 50 in a clockwise direction widens the gap between the sliding door 34 and the fixed door 32.

At extended position (A), the sliding door 34 and the fixed door 32 together define an area of support for products to be packaged. This area depends entirely upon the size of particular products to be packaged, the number of products to be packaged in one case, and the desired packaging configurations. The present sliding door grid contemplates variation in the number of rows and columns and the numbers and types of products to be packaged.

Figure 7:
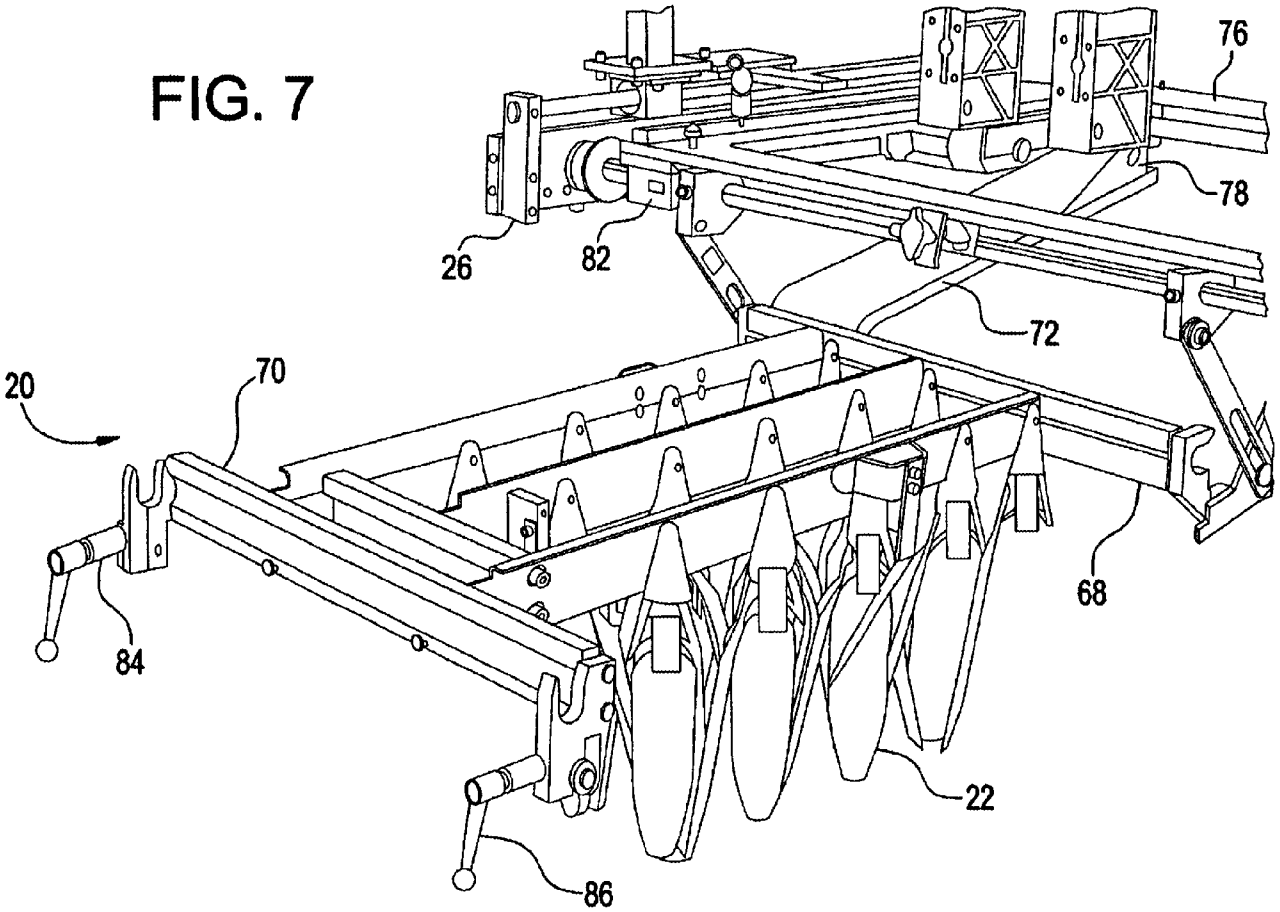
FIG. 7 is a side aspect of the grid basket installation into the mounting frame of the present modular sliding door grid.

Turning now to FIG. 7, the modularity of the present sliding door grid 10 is shown with respect to the lower assembly 14. Grid basket 20 is affixed to the underside of sliding door mounting block 26 by first and second grid basket support bars 68, 70. Actuation of the sliding door (34 in FIG. 1) causes release of products through grid fingers 22 and into packaging (24 in FIG. 1). Grid basket 20 may be affixed to sliding door mounting block 26 in any known manner, but is preferably slidably and removably affixed as shown in FIG. 7.

FIG. 7 shows the exemplary embodiment where each end of the first grid basket bar 68 is placed on two tracks 72, 74 running underneath sliding door mounting block 26. Tracks 72, 74 are attached to the mounting block 26 at end 76 of sliding door mounting block 26 by connecting pins 78, 80. Tracks 72, 74 are attached to the mounting block 26 at end 82 by hinges 72, 74. The grid basket 20 is positioned underneath the mounting block 26 by placing the first grid basket bar 68 on the two tracks 72, 74 and pushing the second grid basket bar 70 until the grid basket 20 locks in place. Quick release members 84, 86 on the second grid basket bar 70 allow the grid basket 20 to be rapidly detached for easy lowering and removal from underneath the sliding door mounting block 26.

Figure 8:
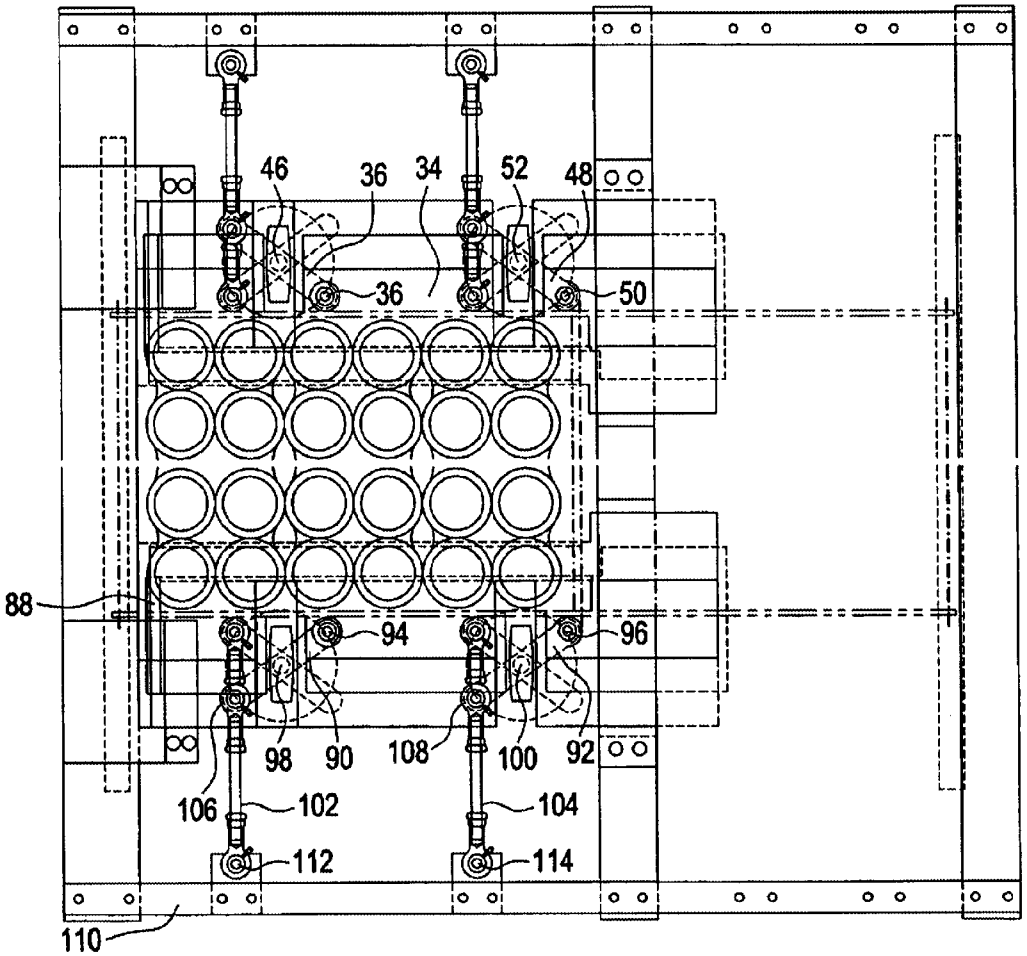
FIG. 8 is an overhead view of an exemplary modular sliding door grid including two sliding doors.

Turning now to FIG. 8, another exemplary embodiment includes dual sliding doors 34, 88. Connectivity for sliding door 34 is as described above for FIG. 1. In this embodiment, sliding door 88 is linked to pivot bars 90, 92 by connecting pins 94, 96. Pivot bars 90, 92 are pierced by pivot pins 98, 100. Opposite connecting pins 94, 96, mechanical linkages 102, 104 connect to pivot bars 90, 92 at connecting pins 106, 108. The mechanical linkages 102, 104 connect to second frame bar 110 at connecting pins 112, 114.

The present modular sliding door grid advantageously moves each door horizontally to release the product for its descent into the case. This action can occur more rapidly, and the retraction can occur almost immediately, allowing the packer to prepare for the next cycle. Exemplary operation of the sliding door grid allows for field operation of at least 40 cases per minute for 8 oz. PET multi-packs.

Speed of packaging machinery is an important industry factor. Thus where speed is a particular concern, it is preferred that the sliding door 34 be opened and closed by an automated system such as is known in the art, that recognizes factors such as a product drop time, product size, and number reset time for second cycle positioning, and receptacle case removal and replacement time. Consideration of these factors, among others, allows sliding doors to be opened and closed at optimal times for efficiency of packaging.

The present modular sliding door grid also advantageously provides reduced infeed elevation as a result of the horizontal motion of the sliding door design versus the vertical swing of prior art trap door grids. This advantage reduces required elevations by up to 6 inches over the prior art and allows the operator easier top access to the bottle infeed.

Additionally, the modular sliding door grid, because it is modular, advantageously allows the grid to be provided as an upgrade for existing case packers or as a replacement for the older trap door grids. The sliding door grid can handle hi-cones, mead-wraps, contour packs and shrink bundles, among others, packed into RSC cases, HSC cases, tab-locked cases, bliss cases and low-walled trays, among others.

Finally, conventional trap door designs were large, preventing their use as part of a quick change assembly. In contrast, this modular sliding door grid can be part of a quick release mechanism that enables quick changeovers and higher speeds. U.S. Pat. No. 4,406,111 to John Raudat, which is incorporated herein in its entirety by reference and which discloses a "Quick Release Subassembly for Shifting Grid Case Packer", describes a quick change mechanism of which the modular siding door can be a part. This modular sliding door has a low profile, a design that enables, essentially guarantees simultaneous release of the mechanism from the connections with the case packer. In other words, this simplified, low profile design enables improved, high speed operation and quick changeover from one sliding door mechanism to another (e.g., due to different size cases or the like).

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A case packer assembly comprising:

an upper assembly and a lower assembly;

a first door assembly is disposed between the upper assembly and the lower assembly, the first door assembly includes:

a first door and a second door, the first door is connected to a frame;

the second door is a slidable door and is in operable communication with the frame;

means for sliding the second door in a first direction when the frame is moved in an opposing second direction.

2. The assembly of claim 1, wherein the means for sliding the second door includes:

at least one mechanical linkage connected to the frame; and at least one pivot bar connected at a first end to the mechanical linkage, the pivot bar having a pivot point around which its first and second ends rotate, wherein the second door is connected to the second end of the pivot bar.

3. The assembly of claim 2, wherein the means for sliding the second door further comprises a second mechanical linkage, connected to a first end of a second pivot bar, the pivot bar having a pivot point around which its first and second ends rotate, the second door connected to the second end of the second pivot bar.

4. The assembly of claim 2, wherein the frame includes a first frame bar connected to a mounting block and a second frame bar connected to the mounting block, the at least mechanical linkage is connected to the first frame bar.

5. The assembly of claim 4, further comprising at least one sliding door guide mounted to the mounting block.

6. The assembly of claim 4, further including first and second tracks mounted to an underside of the mounting block, the first and second tracks separated by a distance equal to the length of a support bar of a grid basket of the lower assembly.

7. The assembly of claim 6, wherein the first and second tracks are bolted to the underside of the mounting block at a first end and hinged at a second end such that the second end may be lowered below the height of the first end.

8. The assembly of claim 2, wherein the first door assembly is connected to the lower assembly.

9. The assembly of claim 1, further comprising a second door assembly, wherein the first door assembly and the second door assembly are interchangeably received between the upper assembly and the lower assembly.

* * * * *